US009156086B2

(12) United States Patent
James

(10) Patent No.: US 9,156,086 B2
(45) Date of Patent: Oct. 13, 2015

(54) MULTI-COMPONENT ASSEMBLY CASTING

(75) Inventor: Allister W. James, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 1059 days.

(21) Appl. No.: 12/795,002

(22) Filed: Jun. 7, 2010

(65) Prior Publication Data

US 2011/0299999 A1 Dec. 8, 2011

(51) Int. Cl.

| | |
|---|---|
| ***F01D 5/18*** | (2006.01) |
| ***B22D 19/00*** | (2006.01) |
| ***B22C 9/04*** | (2006.01) |
| ***C22C 19/03*** | (2006.01) |
| ***F01D 5/14*** | (2006.01) |
| ***F01D 5/28*** | (2006.01) |

(52) U.S. Cl.

CPC . *B22D 19/00* (2013.01); *B22C 9/04* (2013.01); *C22C 19/03* (2013.01); *F01D 5/147* (2013.01); *F01D 5/187* (2013.01); *F01D 5/28* (2013.01); *F05D 2230/211* (2013.01); *F05D 2300/607* (2013.01); *Y10T 29/4932* (2015.01); *Y10T 29/49341* (2015.01)

(58) Field of Classification Search

CPC ..... F01D 5/14; F01D 5/147; F01D 5/28; F01D 5/286; F01D 5/288; F01D 5/282; F01D 25/007

USPC ..... 416/223 R, 226, 229 R, 229 A, 241 R

See application file for complete search history.

(56) References Cited

U.S. PATENT DOCUMENTS 4,321,010 A * 3/1982 Wilkinson et al. ..... 416/92
4,511,306 A 4/1985 Hultgren
4,728,258 A * 3/1988 Blazek et al. ..... 415/137
5,061,154 A 10/1991 Kington
5,062,768 A * 11/1991 Marriage ..... 416/97 R
5,069,265 A 12/1991 Blazek
5,174,715 A 12/1992 Martin
5,182,855 A 2/1993 Martin
5,248,240 A * 9/1993 Correia ..... 415/209.1
5,290,143 A 3/1994 Kington et al.
5,813,832 A 9/1998 Rasch et al.
6,074,706 A * 6/2000 Beverley et al. ..... 427/454
6,193,141 B1 2/2001 Burke et al.
6,331,217 B1 12/2001 Burke et al.
6,331,361 B1 12/2001 Esch et al.
6,413,040 B1 7/2002 Yu et al.
6,607,358 B2 8/2003 Finn et al.
6,617,003 B1 * 9/2003 Lee et al. ..... 428/131
6,800,198 B2 10/2004 Moon et al.
6,929,445 B2 8/2005 Zatroski et al.
7,011,721 B2 3/2006 Harris et al.

(Continued)

*Primary Examiner* — Igor Kershteyn

(57) ABSTRACT

Multi-component vane segment and method for forming the same. Assembly includes: positioning a pre-formed airfoil component (12) and a preformed shroud heat resistant material (18) in a mold, wherein the airfoil component (12) and the shroud heat resistant material (18) each comprises an interlocking feature (24); preheating the mold; introducing molten structural material (46) into the mold; and solidifying the molten structural material such that it interlocks the preformed airfoil component (12) with respect to the preformed shroud heat resistant material (18) and is effective to provide structural support for the shroud heat resistant material (18). Surfaces between the airfoil component (12) and the structural material (46), between the airfoil component (12) and the shroud heat resistant material (18), and between the shroud heat resistant material (18) and the structural material (46) are free of metallurgical bonds.

27 Claims, 4 Drawing Sheets

(56) References Cited

U.S. PATENT DOCUMENTS

| | | | | |
|---|---|---|---|---|
| 7,247,002 | B2 * | 7/2007 | Albrecht et al. | 416/224 |
| 7,377,743 | B2 | 5/2008 | Flodman et al. | |
| 7,452,182 | B2 * | 11/2008 | Vance et al. | 415/135 |
| 7,648,334 | B2 | 1/2010 | Hurst et al. | |
| 8,096,758 | B2 * | 1/2012 | Schiavo | 415/200 |
| 8,215,900 | B2 * | 7/2012 | Morrison | 415/115 |
| 8,292,580 | B2 * | 10/2012 | Schiavo et al. | 416/96 A |
| 8,303,247 | B2 * | 11/2012 | Schlichting et al. | 415/173.1 |
| 2006/0228211 | A1 | 10/2006 | Vance et al. | |
| 2007/0231143 | A1 * | 10/2007 | Boegli et al. | 416/191 |
| 2008/0134685 | A1 | 6/2008 | Bunker et al. | |

* cited by examiner

MULTI-COMPONENT ASSEMBLY CASTING

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The disclosure is generally related to a gas turbine engine hot gas path components and a method for making the same. The disclosure is particularly related to gas turbine engine hot gas path components comprising multiple pre-formed components joined via an assembly casting process.

BACKGROUND OF THE INVENTION

Gas turbine engine components that form part of the hot gas path are exposed to extremely high operating temperatures and stresses, and the temperatures and stresses continue to rise as technology improves and lower emissions and higher efficiencies are required. Several methods exist for creating hot gas path components such as vane segments or blades. Vane rings, for example, may be a single piece for smaller configurations, or may be composed of multiple vane segments in larger configurations. Vane segments may, in turn, be composed of multiple airfoils joined at one end by an outer ring segment, and at the other end by an inner ring segment, or a single airfoil with an outer ring segment and an inner ring segment.

Different materials and structures are known for use in vane segments. For example, monolithic airfoil segments made of polycrystalline superalloys have been used. Polycrystalline superalloy structures have good heat resistance, good mechanical properties, and good oxidation and corrosion resistance. However, modern gas turbines are exceeding the capacity of even these materials. One solution has been to produce monolithic vane segments using a single crystal superalloy. Single crystal superalloys offer exceptional mechanical properties (strength, fracture toughness, fatigue) and a good balance of mechanical properties, heat resistance, and oxidation and corrosion resistance, and are thus well suited for airfoil applications. However, the process for making a monolithic single crystal superalloy vane segment is challenging and unacceptable casting defects frequently result in low part yields, thereby making such parts very expensive. The casing difficulties limit larger sized vane segments to a single airfoil. It is also known in the art to assemble multiple airfoils in a jig and join them together via a casting operation. In this method, commonly referred to as bi-casting, the airfoils are a single type of preformed component and are joined by one material. Other methods for manufacturing vane segments include making an airfoil from more than one component of dissimilar materials and then brazing the assembly to the shroud segments.

However, there is room for improvement with these methods because they retain negative characteristics in terms of their performance, their cost, and/or the performance of the hot gas flowing there through.

BRIEF DESCRIPTION OF THE DRAWINGS

The invention is explained in the following description in view of the drawings that show.

DETAILED DESCRIPTION OF THE INVENTION

Figure 1:
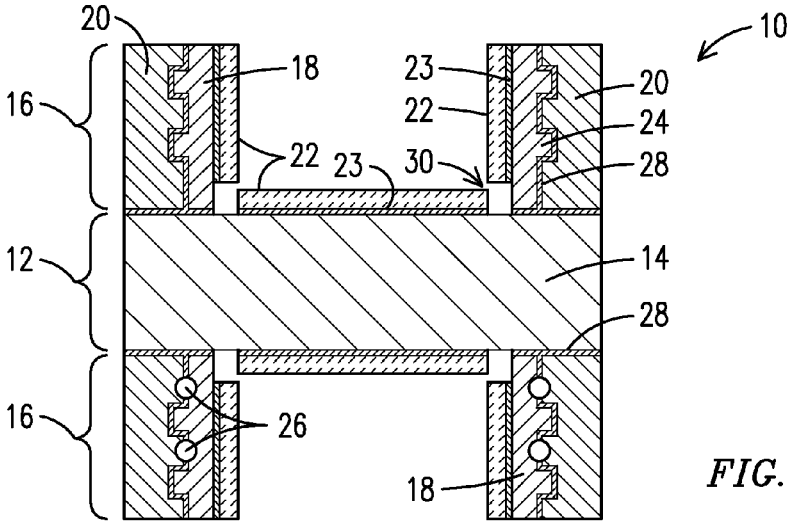
FIG. 1 is a schematic diagram of an embodiment a multi-component cast vane segment.

The present inventor has devised an innovative hot gas path component structure and method for making the structure that may equal or outperform monolithic single crystal superalloy vane segments in terms of mechanical properties, heat resistance, and oxidation and corrosion resistance, yet the components are less expensive, and have numerous configurations available, and the method is faster and more versatile than the method used in conventional hot gas path component manufacturing.

The airfoil of a vane segment must have superior mechanical properties (strength, fracture toughness, fatigue) as well as high heat resistance, and high oxidation and corrosion resistance. The shroud portions of the vane segment do not turn hot gasses, but only contain them, thereby helping to define the boundaries of the hot gas path. As a result, shroud segments do not need the equally superior mechanical properties as the airfoil, though they do need the same high heat resistance, and high oxidation and corrosion resistance. The vane segment as a whole and the airfoil of the vane segment in particular need superior mechanical properties in order to withstand the forces of the gasses, but only the surfaces of the vane segment require high heat resistance, and high oxidation and corrosion resistance. These latter properties are not necessary throughout the entire volume of the vane segment.

The inventor has recognized that a vane segment could be composed of multiple components, where the composition of each component is determined by the role of the component. For example, the hot gas path surface components of the airfoil must exhibit excellent heat resistance, oxidation and corrosion resistance, but the structural requirements for an airfoil spar (i.e. the structural part of an airfoil) and shroud structural components may be different. The cooler structural components of the shroud and airfoil spar require high mechanical properties but do not need the same environmental or high temperature capabilities as a components exposed directly to the hot gas path. Consequently, vane segments can be composed of various preformed components of different materials and properties, tailored to the role in the vane segment that the component plays.

Heat resistance and mechanical properties are primary properties driving vane segment design. There exists a multitude of materials that, when at temperatures below that of the hot gas path environment, have mechanical properties at or beyond those required of structural shroud portions, and some that have mechanical properties at or beyond those required of airfoil spars. These materials would not suffice, however, if exposed to hot gas path environments. These materials would suffice if shielded from the hot gas path environment. Many of these materials are less expensive than materials with high heat resistance.

Material microstructures that have been used because of their mechanical properties as well as heat resistance, oxidation and corrosion resistance include polycrystalline, directionally solidified, and single crystal. Materials that provide outstanding heat resistance, oxidation resistance, and corrosion resistance, but not the structural properties required of a vane segment, are oxide dispersion strengthened (ODS) alloys, including but not limited to PM-2000™ (manufactured by Plansee High Performance Materials), MA956 (manufactured by Special Metals), and ODM-751™ (manufactured by Dour Metal). Examples of other high temperature resistant materials are APM™ and APMT™ (manufactured by Kanthal).

Structural materials that provide suitable mechanical properties for an airfoil but with reduced oxidation resistance and corrosion resistance include CMSX-4™ (manufactured by Cannon-Muskegon); PWA 1484 (manufactured by Cannon-Muskegon); Rene N5 (manufactured by Cannon-Muskegon) Structural materials that provide suitable mechanical properties for a structural shroud portion but with reduced heat resistance, oxidation resistance, and corrosion resistance if exposed to hot gasses include CM247LC™ (manufactured by Cannon-Muskegon); IN939 (manufactured by Special Metals) and IN738 (manufactured by Special Metals)

Any combination of the above materials that provides suitable mechanical properties throughout the vane segment and suitable heat resistance throughout the hot gas path exposed surface of the vane segment are envisioned. Various configurations include those where the vane segment is composed of two portions; an airfoil portion and a shroud portion. In one embodiment one portion may be a monolithic block, i.e. is it composed of one material throughout that provides all the mechanical properties, the heat resistance, and oxidation and corrosion resistance requirements for the portion. The other portion may be composed of a heat resistant surface component that meets the heat resistance, oxidation and corrosion resistance requirements, together with a structural component that supplies the required structural support for the heat resistant component of that portion. In such a configuration, for example, the airfoil could be composed of a monolithic block and the shroud portion could be composed of two components, or vice versa.

Another configuration envisions both the airfoil and the shroud portions being composed of a surface component that meets the heat resistance, oxidation and corrosion resistance requirements, and a structural component that supplies the required structural support. In this embodiment the heat resistant component can withstand the high temperatures of the environment and shield the shroud structural component from the hot gas environment. The shroud structural support component in turn provides structural support for the heat resistant material. All of the configurations can be intermixed as necessary to match design requirements with cost requirements.

Any manner of making the components is acceptable. For example, a component may be cast, or it may be machined. This provides great advantage because materials that offer desired properties but cannot be formed via casting can now be incorporated into a final component. Thus, more materials are available, offering greater design choices. The choice of configuration may also be steered by how the component materials are produced. For example, single crystal superalloy components are significantly easier to manufacture when the geometry is simple. Materials that offer suitable heat resistance are often capable of being formed through a casting process. However, materials such as oxide dispersion strengthened (ODS) alloys are not amenable to forming through a casting process and must be machined. One advantage of the structure and method disclosed herein is that materials such as ODS materials, which can not be cast, can still be used in a vane segment. This advantage widens the range of material and design choice possibilities to a level not available prior to this method and structure. Specifically, this method and structure can now take advantage of superior characteristics of certain materials that could not have been used until this method and structure, because this method and structure accommodate the relative weaknesses of such material.

One of the principal advantages of the disclosed structure and method of manufacture is that metallurgical joints between the different materials present in the prior art are not required (i.e. no welding or brazing) and thus thermal stresses resulting from differences in thermal expansion are minimized. Although the joints are mechanical in nature they are very strong as they do not rely upon any secondary fasteners (e.g. bolting). An additional advantage is that the disclosed structure and method provides an excellent line-on-line fit between the original parts and the cast sections, this can avoid potentially expensive and difficult machining operations.

In one embodiment with a superior combination of mechanical properties, heat resistance, oxidation and corrosion resistance the entire surface exposed to hot gasses is composed of superalloys having a single crystal microstructure. For example, the airfoil may be made of a monolithic single crystal superalloy, and the shroud portion may be composed of a separate single crystal superalloy for the heat resistant portion, and a less expensive structural material (such as CM247LC-CC, IN939 or IN738) to support the single crystal heat resistant material. The airfoil and the shroud heat shield components would have simple geometries and thus avoid the casting defects which often result from changes in shape or cross section present in the complicated prior art monolithic single crystal vane segments. It is understood that a single crystal superalloy would have the required mechanical properties if used throughout the entire volume of the shroud, but advanced single crystal alloys are more expensive than conventionally cast equiaxed alloys that may be used as the shroud structural material. Additionally the low casting yield rates (high scrap) associated with large monolithic single crystal castings make such parts very expensive. As a result in this embodiment all the performance of a monolithic single crystal superalloy vane segment is realized, but the assembled structure would be easier and cheaper to manufacture.

Turning to the drawings, FIG. 1 shows an embodiment of the vane segment 10 that utilizes an airfoil component such as airfoil 12 composed of a monoblock 14, (such as a single crystal superalloy), and the shroud portion 16 composed of a shroud heat resistant component 18 (such as a single crystal superalloy or an oxide dispersion strengthened alloy), a shroud structural component 20 (such as CM247LC-CC, IN939 or IN738), and a thermal barrier coat (TBC) 22. There may also be a bond coat 23 between the TBC and the substrate (i.e. the airfoil or the shroud heat resistant material. The TBC would be applied in a manner that would prevent and cracking or spallation due to movement of the components during operation due to mechanical forces or thermal expansions.

A configuration with a single crystal superalloy monoblock airfoil takes advantage of the superior mechanical, heat resistant, and oxidation and corrosion resistant properties of a single crystal superalloy. The airfoil would have a simple structure and thus avoid the costly pitfalls associated with the complicated prior art monolithic single crystal vane segments. When a single crystal superalloy or an oxide dispersion strengthened alloy is used for the shroud heat resistant component, the configuration also takes advantage of the superior heat resistant properties of the single crystal superalloy or the oxide dispersion strengthened alloy, as well as the structural strength of a lesser expensive material.

Also visible in FIG. 1 are protrusions 24 extending from the shroud heat resistant component 18 into the shroud structural component 20, cooling channels 26 disposed between the shroud heat resistant component 18 and shroud structural component 20, and an oxide layer 28 disposed between adjacent components.

Oxide layers tend to form when the components are heated, and also tend to prevent metallurgical bonds. Thus, the prior art endeavors to avoid the formation of oxide layers, in favor of strong metallurgical bonds. Here, however, an oxide layer 28 may be intentionally formed with the goal of preventing metallurgical bonds between components during manufacturing of the vane segment 10. Cooling channels may be disposed between the shroud structural component 20 and the shroud heat resistant component 18, in order to cool the heat resistant material.

It has been determined that TBC's will adhere to oxide dispersion strengthened alloys five to ten times better than they will adhere to a single crystal superalloy. As a result, an oxide dispersion strengthened alloy with a TBC applied may possess heat resistance properties superior than a single crystal superalloy coated with a TBC. The hot gas path defined by the vane segment 10 is also, unlike the prior art, free of fillets in corners 30. Fillets negatively impact the aerodynamics of the gasses flowing through the hot gas path. In the prior art, however, fillets are necessary at the corners of the monolithic component to reduce stresses and avoid cracking.

Figure 2:
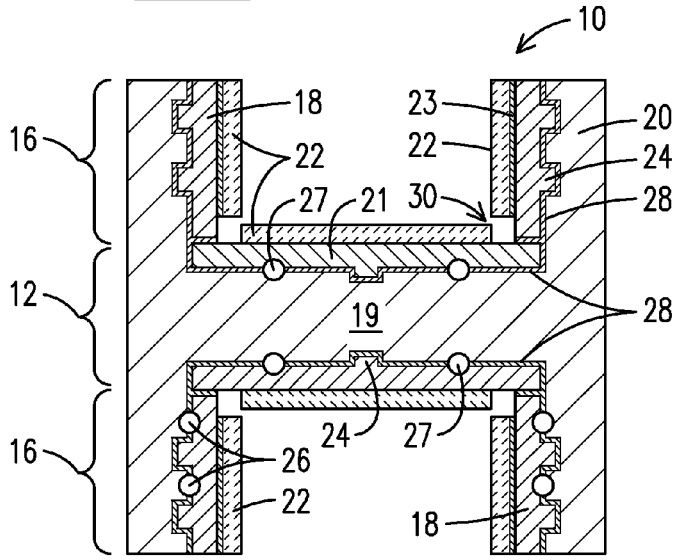
FIG. 2. is a schematic diagram of another embodiment a multi-component cast vane segment.

FIG. 2 shows an embodiment where the airfoil 14 is composed of an airfoil spar (i.e. an airfoil structural support material) 19 behind an airfoil heat resistant material 21. Airfoil heat resistant material 21 may have protrusions 24 to secure the airfoil heat resistant material 21 to the airfoil spar 19. Airfoil heat resistant material 21 may be the same or different as shroud heat resistant material 18. Structural support 20 may also be a monolithic casting. Cooling channels 27 may also be formed in the vane segment 10. These may be disposed between the airfoil spar 19 and the airfoil heat resistant material 21, in order to cool the heat resistant material.

Figure 3:
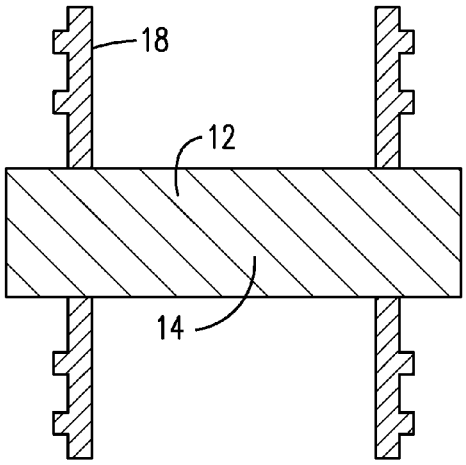
FIG. 3 is a schematic diagram of an initial step in the method for producing an embodiment of a multi-component cast vane segment.
Figure 4:
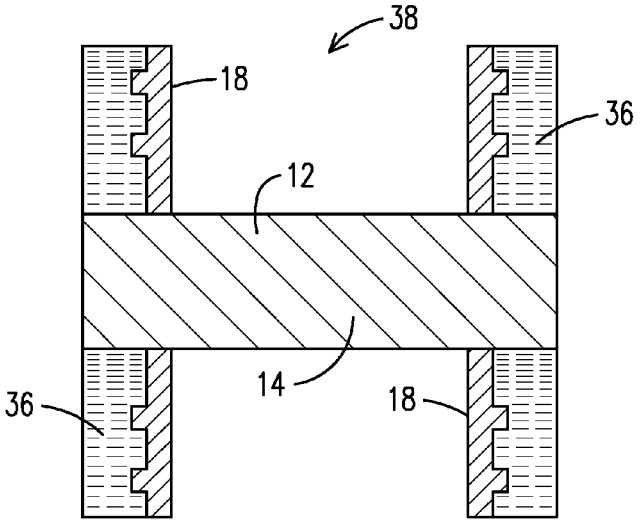
FIG. 4 is a schematic diagram of a step subsequent to that shown in FIG. 3 in the method for producing an embodiment of a multi-component cast vane segment.
Figure 5:
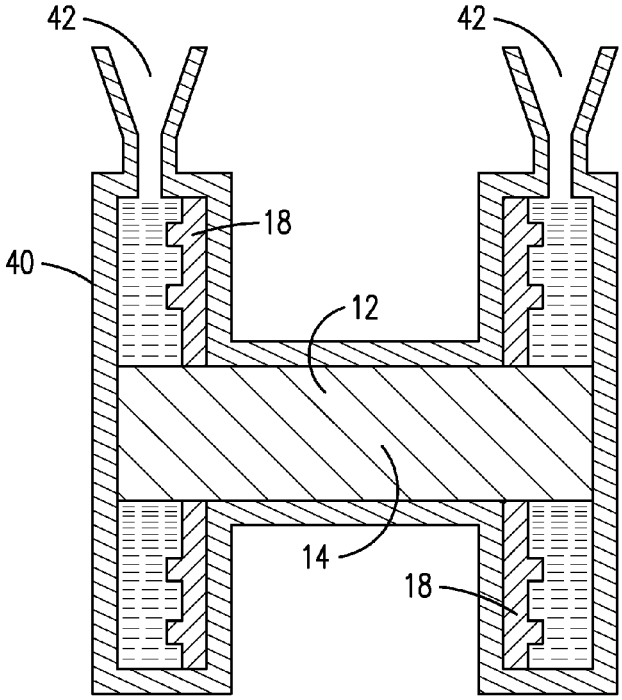
FIG. 5 is a schematic diagram of a step subsequent to that shown in FIG. 4 in the method for producing an embodiment of a multi-component cast vane segment.
Figure 6:
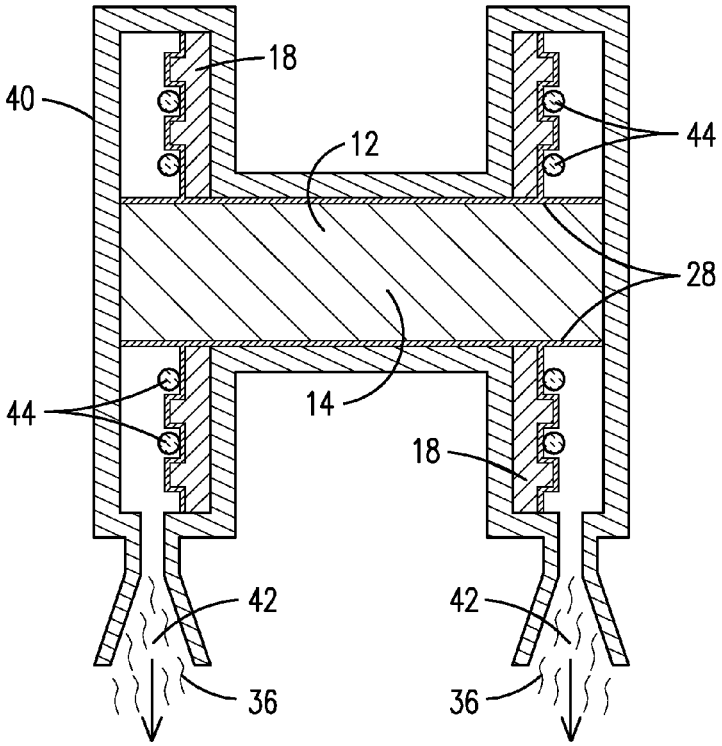
FIG. 6 is a schematic diagram of a step subsequent to that shown in FIG. 5 in the method for producing an embodiment of a multi-component cast vane segment.

FIGS. 3-7 detail method steps for making the multi-component assembly. FIG. 3 shows a pre-formed monolithic airfoil 12 with pre-formed shroud heat resistant components 18 placed about in what will be their final position once the vane segment 10 is completed. The airfoil and the shroud heat resisting components will typically be placed within a wax injection die. The die accurately locates the individual components and any fugitive ceramic casting cores. In FIG. 4 wax 36 is injected into the die to define a final, post-cast shape for a pre-shell assembly 38. Wax 36 may serve to hold the components in place during the shelling operation. FIG. 5 depicts a shell 40 build around the pre-shell assembly 38, with openings 42 for molten material, using casting shell building technology known to those skilled in the art. Risers and runners may be incorporated into the shell to facilitate casting. The shell is fired to gain the desired strength, and as shown in FIG. 6 the wax 36 is removed from the shell 40. The fired mold assembly is then placed inside a casting furnace and preheated in preparation for pouring the molten alloy at which time a thin oxide layer 28 (i.e. on the order of a few microns) may be formed prior to the next step in the process, which is the introduction of the molten alloy. This oxide layer may help prevent the formation of metallurgical bonds. Optionally, fugitive material 44, such as ceramic, may be positioned where internal cooling channels are required. The fugitive material may take the form of a performed casting core or a deposited using a spray technique (e.g. Air Plasma Spray or Electron Beam Physical Vapor Deposition). In one embodiment the fugitive material may be placed next to the shroud heat resistant material 18 and held in place using techniques known in the art (e.g. platinum pins). This fugitive material 44 may subsequently be removed using techniques know in the art, such as leaching in sodium hydroxide, after the molten alloy is poured in the shell 40 in the next step. Once the fugitive material 44 was removed, cooling channels would remain.

Figure 7:
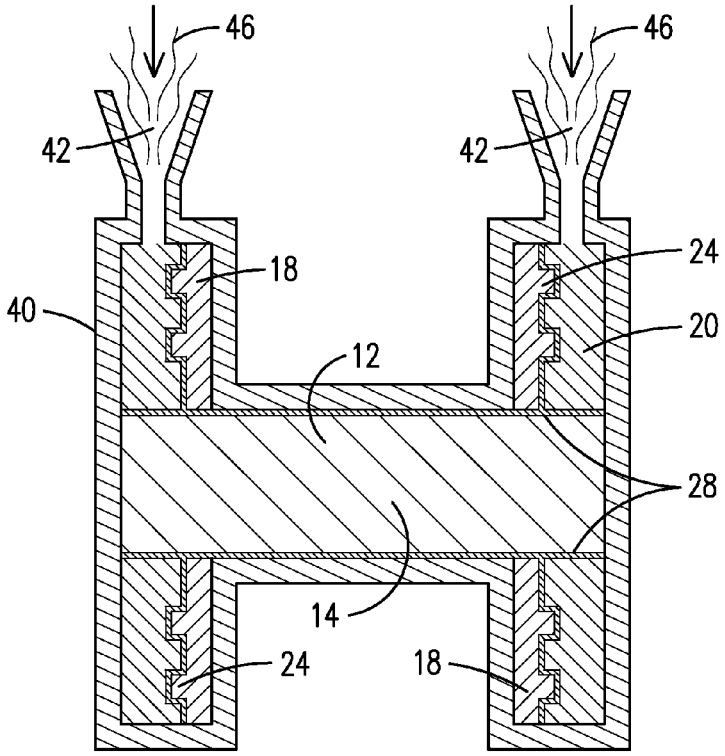
FIG. 7 is a schematic diagram of a step subsequent to that shown in FIG. 6 in the method for producing an embodiment of a multi-component cast vane segment.

In FIG. 7 molten alloy 46 is poured into the shell 40. Molten alloy 46 may be different material than the heat resistant material and the airfoil (or airfoil heat resistant) material. Molten alloy 46 solidifies without forming any metallurgical bonds with the pre-formed components in the shell 40, thereby forming the structural support 20 for the shroud heat resistant material 18. The molten alloy may completely fill the mold surrounding the protrusions 24 (i.e. interlocking features) that extend into the mold cavity. Thus as the alloy solidifies it firmly locks onto the shroud heat shield component. I.e. when the molten alloy 46 solidifies it is held in place, and holds the other components in place, through interaction with geometric protrusions 24. These permit the components of the completed vane segment 10 to remain fixed in position relative to each other. Once cooled sufficiently, the shell 40 is removed, producing a completed vane segment.

Figure 8:
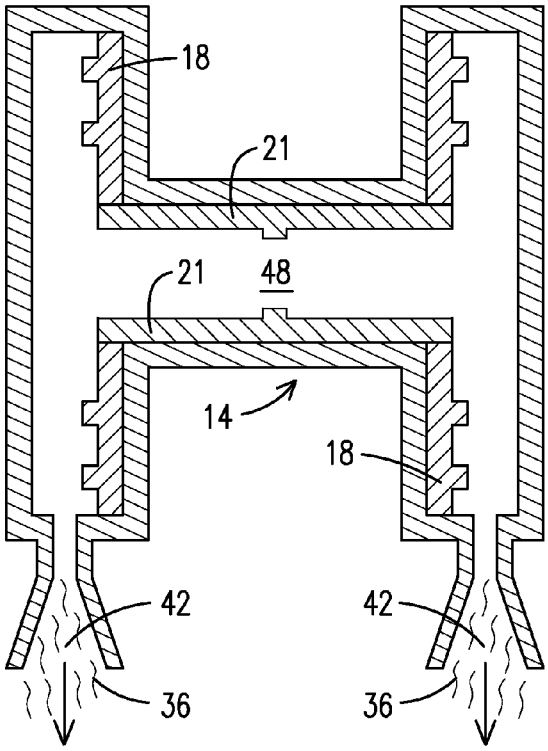
FIG. 8 is a schematic diagram of a step subsequent to that shown in FIG. 5 in the method for producing an embodiment of a multi-component cast vane segment.
Figure 9:
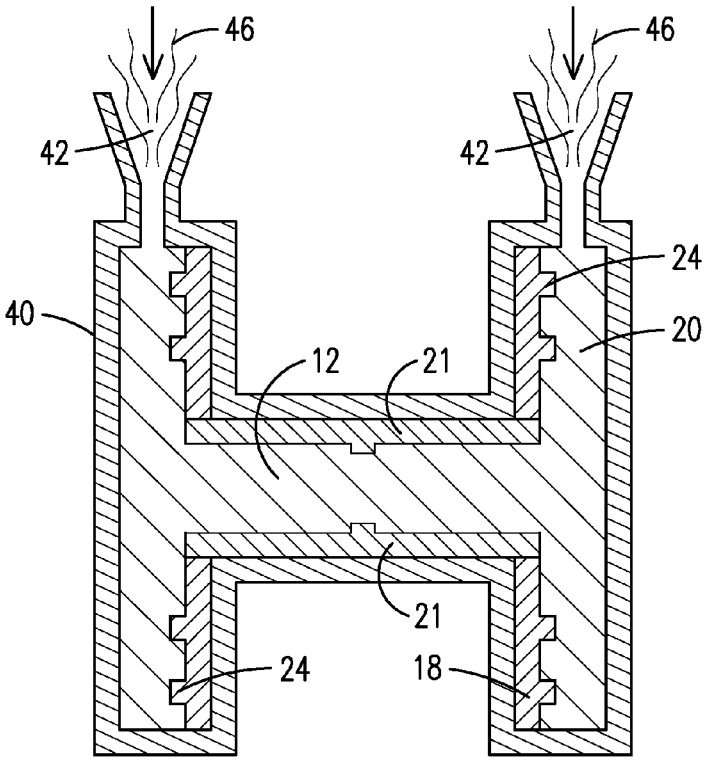
FIG. 9 is a schematic diagram of a step subsequent to that shown in FIG. 8 in the method for producing another embodiment of a multi-component cast vane segment.

FIG. 8 shows the step of FIG. 6 for an alternate embodiment, where the airfoil portion 14 is will no longer be a monolithic block, but instead will be composed of two components; an airfoil heat resistant material 21 and an airfoil spar 19 (not shown). Airfoil heat resistant material 21 may be different from shroud heat resistant material 18. This embodiment differs in that wax 36 is present in airfoil spar region 48 and is removed along with the rest of the wax 36 in this step. In FIG. 9, as in FIG. 7, molten alloy 46 is poured into the shell 40, thereby forming the shroud structural support 20 for the shroud heat resistant material 18 and airfoil spar 19 for airfoil heat resistant material 21. As before, when the molten alloy 46 solidifies it is held in place, and holds the other components in place, through interaction with geometric protrusions 24. Once cooled sufficiently, the shell 40 is removed, producing a completed vane segment.

It has been shown that the multi-component vane segment and method for producing the multi-component vane segment present options not available in the prior art, and yields a vane segment that may perform as well as, if not better than the prior art vane segments, for less cost.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A vane segment comprising;

an airfoil comprising an airfoil structural material; and a shroud segment comprising a shroud heat resistant material and a cast shroud structural material underlying and providing structural support for the shroud heat resistant material, wherein the shroud heat resistant material is discrete from the airfoil structural material, wherein the shroud heat resistant material is set apart from the shroud structural material by not more than a layer of oxides therebetween, wherein the shroud structural material is discrete from, cast around, and secured to an end of the airfoil structural material and acts as a monolithic interlock between the airfoil structural material and the shroud heat resistant material, and wherein a joint between the shroud structural material and the airfoil structural material is free of metallurgical bonds.

2. The vane segment of claim 1, wherein the shroud structural material has superior structural properties but inferior thermal properties compared to the shroud heat resistant material.

3. The vane segment of claim 1, wherein the airfoil further comprises an airfoil heat resistant material set apart from the airfoil structural material by not more than a layer of oxides therebetween, and wherein the airfoil structural material underlies and provides structural support for the airfoil heat resistant material.

4. The vane segment of claim 1, wherein the vane segment comprises an oxide layer between the shroud structural material and the airfoil structural material that is effective to prevent a metallurgical bond between two respective abutting surfaces.

5. The vane segment of claim 4, wherein the oxide layer is also disposed between the shroud structural material and the shroud heat resistant material, the shroud heat resistant material further comprising a cooling channel formed in the shroud structural material and at least partly under a part of the oxide layer that is between the shroud structural material and the shroud heat resistant material.

6. The vane segment of claim 1, wherein the airfoil structural material and the shroud heat resistant material are different.

7. The vane segment of claim 1, wherein the airfoil structural material is a monolithic single crystal superalloy and the shroud heat resistant material is an oxide dispersion strengthened alloy.

8. The vane segment of claim 1, wherein the airfoil structural material is a monolithic single crystal superalloy and the shroud heat resistant material is a single crystal superalloy.

9. The vane segment of claim 1, wherein the shroud heat resistant material is an oxide dispersion strengthened alloy, the vane segment comprising a thermal barrier coating applied to the oxide dispersion strengthened alloy.

10. The vane segment of claim 9, comprising a bonding layer between the thermal barrier coating and the oxide dispersion strengthened alloy.

11. A gas turbine engine comprising the vane segment of claim 1.

12. The vane segment of claim 1, wherein the airfoil consists of a monolith.

13. A vane segment comprising;

an airfoil; and a shroud segment comprising a shroud heat resistant material and a cast shroud structural material underlying and providing structural support for the shroud heat resistant material, wherein the shroud heat resistant material is discrete from the airfoil, and wherein the shroud heat resistant material is separated from the shroud structural layer by not more than a layer of oxides therebetween, wherein a joint between the shroud heat resistant material and the airfoil is free of metallurgical bonds, wherein the shroud structural material acts as a monolithic interlock between the shroud heat resistant material and the airfoil.

14. The vane segment of claim 13, wherein the shroud structural material and the airfoil are discrete from each other, wherein the shroud structural material is cast around and secured to an end of the airfoil, wherein a joint between the shroud structural material and the airfoil is free of metallurgical bonds, and wherein the shroud structural material is separated from the airfoil by not more than a layer of oxides therebetween.

15. The vane segment of claim 13, wherein the airfoil further comprises an airfoil structural material underlying and providing structural support for an airfoil heat resistant material, and wherein the shroud structural material and the airfoil structural material are part of a monolithic body.

16. A method for forming a vane segment comprising:

positioning a pre-formed airfoil component and a pre-formed shroud heat resistant material in a mold, wherein the airfoil component and the shroud heat resistant material are discrete from each other and wherein each comprises an interlocking feature;

preheating the mold;

introducing molten structural material into the mold; and solidifying the molten structural material around an end of the pre-formed airfoil component to form a monolithic body that interlocks the pre-formed airfoil component with respect to the preformed shroud heat resistant material and is effective to provide structural support for the shroud heat resistant material, and wherein surfaces between the airfoil component and the cast structural material, between the airfoil component and the shroud heat resistant material, and between the shroud heat resistant material and the cast structural material are free of metallurgical bonds and separated from each other by not more than a layer of oxides therebetween.

17. The method of claim 16, wherein solidifying the molten structural material occurs in a manner that prevents melting of exposed surfaces of the airfoil component and the shroud heat resistant material.

18. The method of claim 17, wherein preheating the mold occurs in a manner that forms an oxide layer on a surface of at least one of the airfoil component and the shroud heat resistant material, wherein the oxide layer is effective to prevent a metallurgical bond.

19. The method of claim 18, comprising placing fugitive material such that a void that remains once the fugitive material is removed forms a cooling channel in the cast structural material and under the oxide layer, and the method comprises removing the fugitive material.

20. The method of claim 19, wherein the cooling channel is formed into the cast structural material and an abutting heat resistant material.

21. The method of claim 20, wherein the airfoil component and the shroud heat resistant material are different.

22. The method of claim 20, wherein the airfoil component is a single crystal superalloy and the shroud heat resistant material is an oxide dispersion strengthened alloy.

23. The method of claim 16, wherein the airfoil component is a single crystal superalloy and the shroud heat resistant material is a single crystal superalloy.

24. The method of claim 16, wherein the shroud heat resistant material is an oxide dispersion strengthened alloy, the method comprising coating the shroud heat resistant material with a thermal barrier coating.

25. The method of claim 24, comprising applying a bonding layer between the shroud heat resistant material and the thermal barrier coating.

26. The method of claim 16, wherein the preformed components are metal alloys, and wherein the cast structural material is a metal alloy.

27. A method for making a gas turbine engine comprising the method of claim 16.

* * * * *